US006974513B2

(12) United States Patent
Kepka

(10) Patent No.: US 6,974,513 B2
(45) Date of Patent: Dec. 13, 2005

(54) COSMETIC APPLICATOR AND METHOD AND SYSTEM FOR MANUFACTURING THE APPLICATOR

(76) Inventor: Stanley W. Kepka, 186 Wertsville Rd., Ringoes, NJ (US) 08551

( * ) Notice: Subject to any disclaimer, the term of this patent is extended or adjusted under 35 U.S.C. 154(b) by 105 days.

(21) Appl. No.: 10/383,696

(22) Filed: Mar. 6, 2003

(65) Prior Publication Data

US 2003/0217759 A1 Nov. 27, 2003

Related U.S. Application Data

(60) Provisional application No. 60/362,274, filed on Mar. 6, 2002.

(51) Int. Cl.[7] ..... A46D 9/00; B29C 41/08

(52) U.S. Cl. ..... 156/72; 156/279; 427/462; 427/463

(58) Field of Search ..... 156/72, 279; 427/462–464

(56) References Cited

U.S. PATENT DOCUMENTS 4,527,575 A * 7/1985 Vasas ..... 132/218
4,689,186 A * 8/1987 Bornat ..... 264/6
4,724,664 A * 2/1988 Goerens ..... 57/207
4,927,281 A 5/1990 Gueret
5,063,947 A 11/1991 Gueret
5,165,760 A 11/1992 Gueret
5,482,059 A 1/1996 Miraglia
6,283,664 B1 * 9/2001 Gueret ..... 401/261
2002/0164192 A1 11/2002 Gueret
2003/0151206 A1 * 8/2003 Smith ..... 277/355

* cited by examiner

*Primary Examiner*—Sam Chuan Yao
(74) *Attorney, Agent, or Firm*—Mathews, Shepherd, McKay & Bruneau, P.A.

(57) ABSTRACT

The present invention relates to a method and system of manufacturing a cosmetic applicator in which a predetermined pattern of flocking bristles are dispensed toward the applicator and are adhered to the applicator by an adhesive. The flocking bristles can be dispensed using a flocking dispenser. The flocking dispenser is moveable in a longitudinal direction forward and backward along the sides and tip of the applicator. During or after movement of the flocking dispenser, the applicator can be rotated around its longitudinal axis. The movement of the flocking dispenser and rotation of the applicator can be controlled to provide the desired pattern of flocking bristles. The density of distribution of the flocking bristles can be controlled by varying the speed of movement and rotation of the applicator and the amount of flocking bristles which are dispensed from the flocking dispenser. For example, a high density of flocking bristles can be applied to extend radially from the tip. The flocking bristles can include one or more types of bristles which differ by one or more of material, cross section, shape, length, diameter or composition.

13 Claims, 2 Drawing Sheets

COSMETIC APPLICATOR AND METHOD AND SYSTEM FOR MANUFACTURING THE APPLICATOR

This application claims priority of Provisional Application No. 60/362,274, filed Mar. 6, 2002, entitled "Mascara Applicator," the contents of which are incorporated in its entirety into this application.

BACKGROUND OF THE INVENTION

1. Field of the Invention

The invention relates to a cosmetic applicator and a method and system of manufacturing the applicator in which a plurality of bristles can be attached to the applicator in a predetermined distribution using a flocking dispenser and movement controlled system.

2. Description of the Related Art

Conventional applicators for mascara eyebrow, eyelashes lotion or the like comprise a handle and at the free end of which is applicator. In general, the core of the brush is formed by two branches of a metal wire twisted into a helix. The bristles extend in the turns formed by the twisted branches. The tips of the bristles define a generally cylindrical outer surface having two diametrically opposed channels and application surfaces helically disposed along the length of the brush portion. The bristle portion is then trimmed to desired shape. The bristles permit penetration of the eyelashes or hair.

It has been suggested to improve uniform distribution of mascara to the eyelashes by including bristles of different types. U.S. Pat. No. 4,927,281 describes a brush for applying mascara in which cross sections of the bristles have different shapes of at least two types. The applicator can include a plurality of bristles wedged into the spirals of the branches of helically twisted metal wire which form the core of the brush. Because the bristle cross sections are varied in shape and the dimensions of the cross sections and the materials may differ, zones of different flexion are created upon wiping and a variable distribution of the product over the brush is obtained.

U.S. Pat. No. 5,063,947 describes a brush having two different diameter bristles of a large diameter and a smaller diameter. Bristles of the larger diameter have at their ends small, shredded hooks. The bristles are gripped between two branches of a metal wire twisted into a helix. The cross sections of the large diameter bristles can have different forms such as solid circular form, hollow circular form, cruciform, multilobed form and horseshoe form.

U.S. Pat. No. 5,165,760 describes a process for making a brush for applying a cosmetic product in which a plurality of bristles transversely implanted in a core include a mixture of relatively soft bristles and relatively stiff bristles. The relatively soft bristles have a greater length than the relatively stiff bristles. The relatively soft bristles and stiff bristles are introduced between two wires which are twisted together.

U.S. Pat. No. 5,482,059 describes a mascara brush having three sections and three types of bristles mounted on a metal wire twisted about itself as a metal helix. A middle section includes two different bristle types of uniform length and two end sections contain a third type of bristle.

The above-described patents have the drawback of being difficult to change the shapes and locations of the bristles along the brush because of the limitation of the bristles being gripped between a pair of metal wires.

U.S. patent application Ser. No. 2002/0164192 describes a device for applying a product in which fibers include at least one particle configured to generate a magnetic field. A brush is formed at a core of twisted wire with bristles being held by the twisted wire core. The bristles can comprise the fibers configured to generate a magnetic field. In one embodiment, fibers presenting magnetic properties comprise flocking on an end piece. A magnetic field having a predefined orientation can be generated by the fibers when a product is applied for encouraging microcirculation and penetration of active agents.

It is desirable to provide an improved applicator and method for manufacture thereof in which a plurality of bristles are attached to the applicator in a predetermined distribution using flocking technology.

SUMMARY OF THE INVENTION

The present invention relates to a method and system of manufacturing a cosmetic applicator in which a predetermined pattern of flocking bristles are dispensed toward the applicator and are adhered to the applicator by an adhesive. The flocking bristles can be dispensed using a flocking dispenser. The flocking dispenser is moveable in a longitudinal direction forward and backward along the sides and tip of the applicator. During or after movement of the flocking dispenser, the applicator can be rotated around its longitudinal axis. The movement of the flocking dispenser and rotation of the applicator can be controlled to provide the desired pattern of flocking bristles. The density of distribution of the flocking bristles can be controlled by varying the speed of movement and rotation of the applicator and the amount of flocking bristles which are dispensed from the flocking dispenser. For example, a high density of flocking bristles can be applied to extend radially from the tip. The flocking bristles can include one or more types of bristles which differ by one or more of material, cross section, shape, length or diameter or internal composition/bi-component fibers.

In one embodiment, a bi-level applicator is formed including two types of flocking bristles. The first type of flocking bristles are formed of substantially mono-layer straight bristles. The second type of flocking bristles are formed of bi-component bristles in which the bristles can crimp to form a substantially curved bristle upon application of thermal treatment or solvent treatment.

In an alternate embodiment, secondary flocking can be applied to adhere to flocking bristles. The second flocking provides a rough surface to improve holding of a cosmetic product on the surface of the flocking bristle.

The invention will be more fully described by reference to the following drawings.

DETAILED DESCRIPTION

Figure 1:
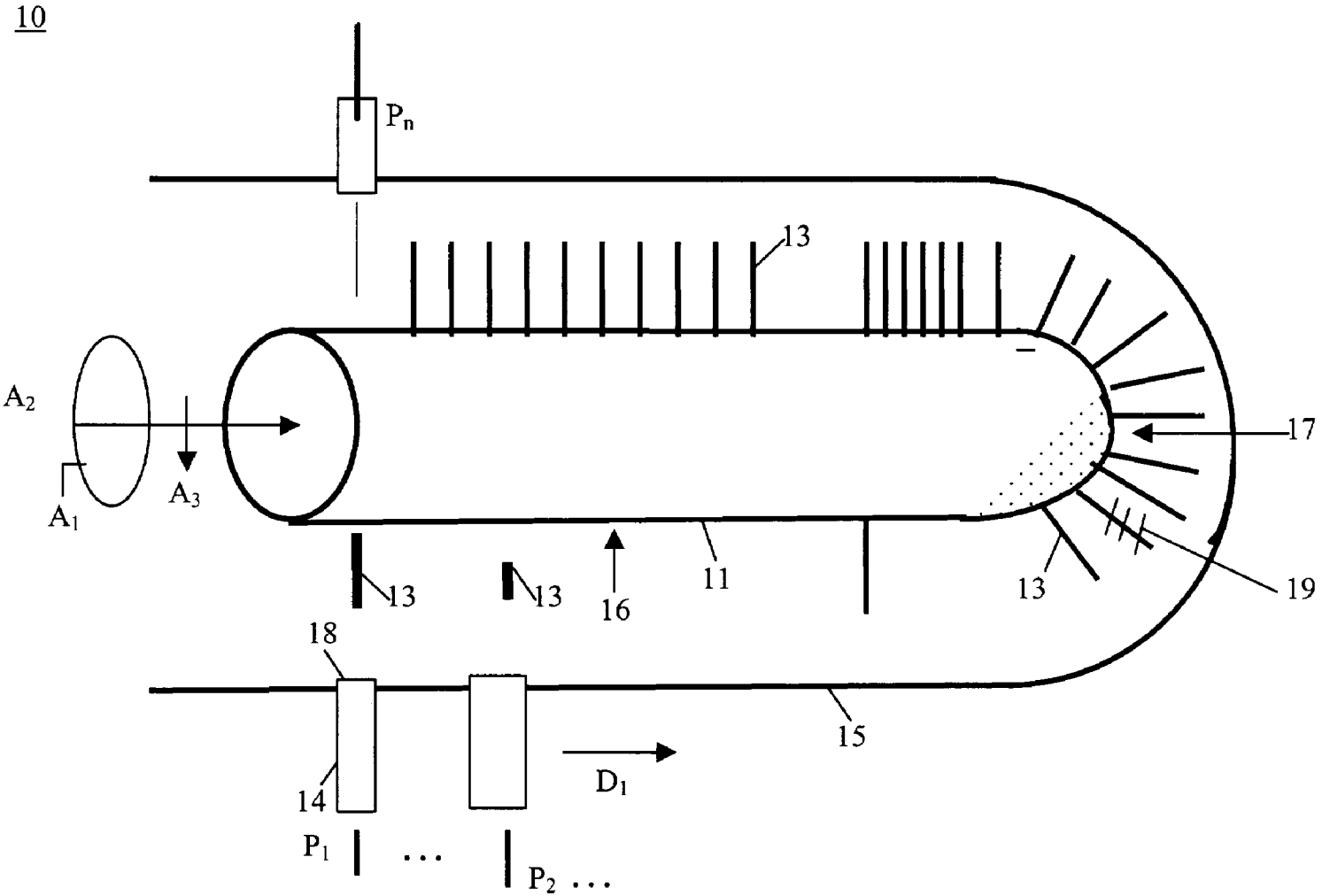
FIG. 1 is a schematic diagram of a system for manufacturing a cosmetic applicator.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a schematic diagram of a system for manufacturing a cosmetic applicator 10 in accordance with the teachings of the present invention. Adhesive film 11 is applied to one or more portions of stem 12. Adhesive film 11 is applied to portions of stem 12 selected as portions to which flocking bristles 13 can be attached. For example, adhesive film 11 can be applied by dipping or spraying to form a substantially uniform film based on the surface tension, viscosity, additives of the adhesive film. Suitable adhesives include polymeric adhesive materials.

Flocking dispenser 14 dispenses flocking bristles 13 towards stem 12. Flocking dispenser 14 can move forward and backwards along dispenser track 15 in the direction of arrow $D_1$ for applying flocking at predetermined positions $P_1$–$P_n$ along sides 16 and tip 17 of stem 12. During or after movement of flocking dispenser 14, stem 12 can be rotated around its axis in the direction of arrow $A_1$ for applying flocking bristles 13 at predetermined positions along stem 12. Speed of flocking dispenser 14 along dispenser track 15 and speed of rotation of stem 12 can be used to control the density of deposition of flocking bristles 13 onto adhesive film 11. Flocking bristles 13 can have a predetermined cross section shape, length and diameter for providing a desired effect. One or more types of flocking bristles 13 defined by having different shapes, lengths or diameters can be used.

For example, flocking bristles 13 can be applied parallel along a longitudinal axis $A_2$ of stem 12 by controlled movement of flocking dispenser 14 in a longitudinal direction along dispenser track 15. Flocking bristles 13 can be applied perpendicular along perpendicular axis $A_3$ of stem 12 by controlled rotation of stem 12. Alternatively, flocking bristles 13 can be applied diagonally along longitudinal axis $A_2$ upon controlled movement of flocking dispenser 14 along dispenser track 15 and rotation of stem 12. In an alternate embodiment, flocking bristles 13 can be applied helically along longitudinal axis $A_2$ upon controlled movement of flocking dispenser 14 along dispenser track 15 and rotation of stem 12. Flocking bristles 13 can be applied with increased density at tip 17 of stem 12 with flocking bristles 13 pointed forward. In this embodiment, flocking bristles 13 are focused to a point away from tip 17 thereby enabling stem 12 to extend into hard to reach areas such as around the eye. After adherence of flocking bristles 13 on adhesive film 11, resin curing can be applied to flocking bristles 13 to allow flocking bristles 13 to become permanently attached to adhesive film 11 by one end.

Flocking dispenser 14 can apply flocking bristles 13 mechanically, electrostatically or by a combination of both technologies. Mechanical application can include wind blown. Electrostatic flocking application utilizes a field of static electricity to orient fibers and promote their perpendicular alignment to the substrate surface. This technique optimizes the result obtained with longer fibers. In this method, stem 12 passes between potentials of a high voltage field. An electrode is utilized to give flocking bristles 13 a charge. The charged fibers become aligned with the electric field line of force of the ground potential which is formed by the substrate and/or the grounded parts of the machine. Flocking bristles 13 are attracted to adhesive film 11 where they become embedded.

In one embodiment, electrostatic flocking can incorporate a pneumatic process to propel flocking bristles 13 towards stem 12 using a wind or air stream. Flocking bristles 13 can be applied with nasal 18 for generating an electrical field and depositing force.

Flocking dispenser 14 places flocking bristles 13 on a surface of stem 12 in a controlled manner. By using an electrical field as driving force for fiber deposition, flocking dispenser 14 can provide an array of flock which can be directed to selected positions of stem 12. Controlled movements of flocking dispenser 14 along stem 12 allow covering a desired area with flocking bristles 13 with a predetermined position and distance between flocking bristles 13. Controlling positioning of flocking dispenser 14 can be accomplished by using a computer controlled step motor controlled by software to achieve the desired effect.

Flocking dispenser 14 can apply secondary flocking 19 to one or more of flocking bristles 13. Adhesive is applied to flocking bristles 13. For example, adhesive can be applied by spraying or misting blocking bristles 13. Secondary flocking 16 can comprise substantially fine particles having a size in the range of about 0.1 mm to about 7 mm. Secondary flocking 19 provides a rough surface of flocking bristles 13 to provide improved holding of mascara on a surface of flocking bristles 13.

Figure 2:
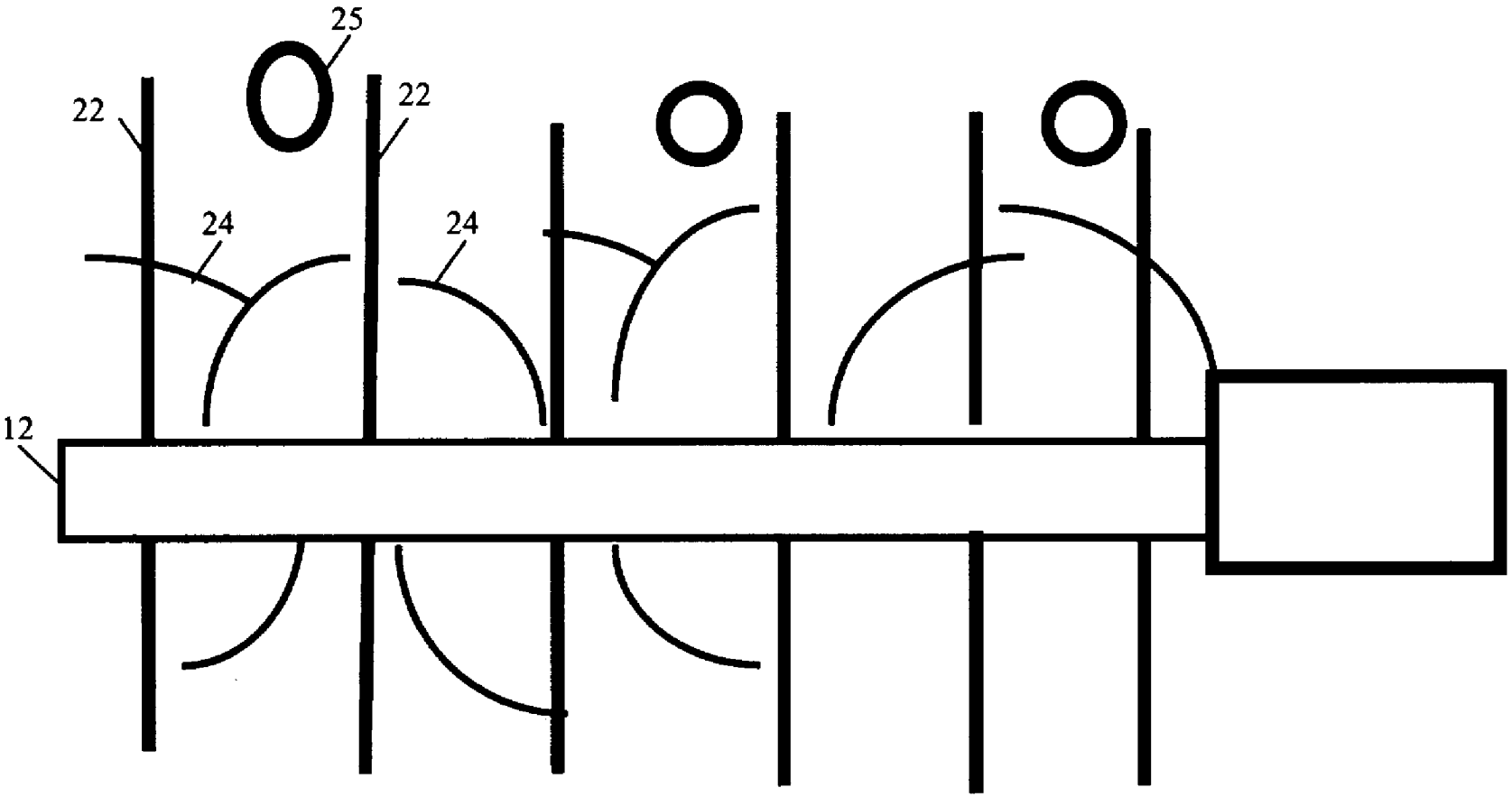
FIG. 2 is a schematic diagram of a bi-level applicator.

FIG. 2 is a schematic diagram of a bi-level applicator 20. Two types of flocking bristles 13 are applied by flocking dispenser 14 to stem 12. A first type of flocking bristles are formed of substantially straight mono-component bristles 22. A second type of flocking bristles 13 are formed of bi-component flocking bristles formed of a first and second material in which one material expands more than the other during application of thermal treatment or solvent treatment to crimp and thereby form substantially curved bristles 24. Bi-level applicator 20 can include distribution of substantially curved bristles 24 between substantially straight bristles 22 to provide improved opportunities to apply bending to eyelashes 25 during mascara deposition thereby providing a curvature to the eyelashes. The distribution of curved bristles 24 between substantially curved bristles can be determined by pre-mixing a predetermined ratio of the substantially curved bristles to the substantially straight bristles for simultaneous dispersion by flocking dispenser 14. For example, the ratio of substantially curved bristles to substantially straight bristles can be in the range from about 1.0% to about 100%.

It is to be understood that the above-described embodiments are illustrative of only a few of the many possible specific embodiments which can represent applications of the principles of the invention. Numerous and varied other arrangements can be readily devised in accordance with these principles by those skilled in the art without departing from the spirit and scope of the invention.

I claim:

1. A method for manufacturing a cosmetic applicator comprising the steps of:

applying an adhesive to one or more portions of a stem and a tip of said stem of said cosmetic applicator; and dispensing a predetermined pattern of flocking bristles toward said adhesive for contact with said adhesive, wherein said flocking bristles are adhered to said adhesive;

said step of dispensing is performed with a flocking dispenser and further comprising the steps of:

moving said cosmetic flocking dispenser in a longitudinal direction around one or more sides of said stem and around said tip of said stem during said step of dispensing said predetermined pattern of flocking bristles; and rotating said cosmetic applicator about a longitudinal axis of said cosmetic applicator during or after said step of moving said flocking dispenser for applying flocking at predetermined positions along said sides of said stem and said tip of said stem.

2. The method of claim 1 wherein said predetermined pattern comprises one or more rows oriented parallel to a longitudinal axis of said cosmetic applicator.

3. The method of claim 1 wherein said predetermined pattern comprises a plurality of flocking bristles extending radially from a tip of said applicator.

4. The method of claim 1 wherein said predetermined pattern comprises one or more rows oriented perpendicular to a longitudinal axis of said cosmetic applicator.

5. The method of claim 1 wherein said predetermined pattern comprises one or more rows oriented diagonally to a longitudinal axis of said cosmetic applicator.

6. The method of claim 1 wherein said predetermined pattern comprises one or more rows oriented in a helical line to a longitudinal axis of said cosmetic applicator.

7. The method of claim 1 wherein a plurality of types of flocking bristles are used in said step of dispensing a predetermined pattern of flocking bristles, wherein said types of flocking bristles are defined by one or more of material, cross section, shape, length or diameter.

8. The method of claim 1 further comprising the steps of:

applying a second adhesive to one or more of said flocking bristles; and dispensing a secondary flocking to said second adhesive applied to said flocking bristles adhered on said cosmetic applicator.

9. The method of claim 1 wherein after said step of dispensing a predetermined pattern of flocking bristles further comprising the step of:

curing said adhesive.

10. The method of claim 1 further comprising the step of:

controlling a speed of movement of said flocking dispenser and a speed of rotation of said cosmetic applicator for controlling a density of distribution of said flocking bristles in said predetermined pattern.

11. The method of claim 1 wherein said flocking bristles comprise a first type formed of a substantially straight bristle and a second type formed of a substantially curved bristle.

12. The method of claim 11 wherein said substantially straight bristle is formed of a mono-component material.

13. A method for manufacturing a cosmetic applicator comprising the steps of:

applying an adhesive to one or more portions of a stem of said cosmetic applicator; and dispensing a predetermined pattern of flocking bristles toward said adhesive for contact with said adhesive, wherein said flocking bristles are adhered to said adhesive, said flocking bristles comprise a first type formed of a substantially straight bristle and a second type formed of a substantially curved bristle wherein said substantially straight bristle is formed of a mono-component material and said substantially curved bristle is formed of a bi-component material, said bi-component material being substantially curved upon application of heat treatment or solvent treatment.

* * * * *